United States Patent [19]

Perrone, deceased et al.

[11] 4,277,063

[45] Jul. 7, 1981

[54] SUPPORT DEVICE FOR STRENGTHENING THE HAND GRIPPING OF RACQUET HANDLES AND OTHER SHAFT MEMBERS

[75] Inventors: Albert L. Perrone, deceased, late of Westwood, N.J.; Mary Perrone, administratrix, 43 Brickell Ave., Westwood, N.J. 07675

[73] Assignee: Mary Perrone, Westwood, N.J. ; administratrix, Estate of Albert Perrone

[21] Appl. No.: 24,586

[22] Filed: Mar. 28, 1979

[51] Int. Cl.[3] ..... A63B 69/38

[52] U.S. Cl. ..... 273/75; 273/165

[58] Field of Search ..... 273/29 A, 73 R, 73 J, 273/75, 81 R, 81 D, 165, 166

[56] References Cited

U.S. PATENT DOCUMENTS

| | | | |
|---|---|---|---|
| 2,780,464 | 2/1957 | Ashley | 273/165 |
| 3,614,100 | 10/1971 | Spitz | 273/75 |
| 3,712,618 | 1/1973 | Berzatzy | 273/75 |
| 4,068,318 | 1/1978 | McMahon | 273/29 A X |

FOREIGN PATENT DOCUMENTS

| | | | |
|---|---|---|---|
| 2220289 | 10/1974 | France | 273/75 |

*Primary Examiner*—Richard J. Apley

*Attorney, Agent, or Firm*—Howard E. Thompson, Jr.

[57] ABSTRACT

A support device is provided for strengthening the hand gripping of racquet handles and other shaft members in the form of an elongated sheet member formed at least in part of resiliently expansible material having means at one end for adjustably securing the member to a shaft to be gripped and an aperture at the other end of the member of a size to closely and expansibly engage the shaft closely adjacent the gripping hand with the spacing of said securing means and aperture being such that the device as mounted on a racquet handle or other shaft member forms a loop which receives the hand with sufficient resilient tension to hold the shaft firmly to the palm of the hand even as the gripping action of the fingers may be relaxed. The device can be a unitary member or a two-part member with overlapped portions aligning with the back of the hand and adjustably secured together by quickly engageable and disengageable means.

19 Claims, 13 Drawing Figures

Fig. 1.
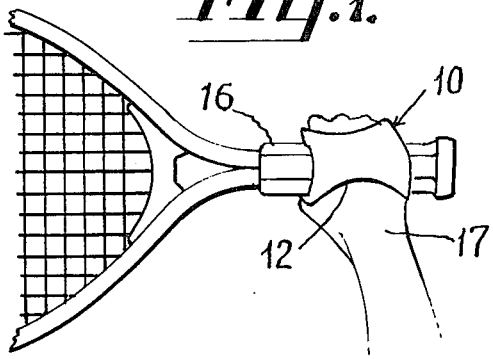
Fig. 1a.
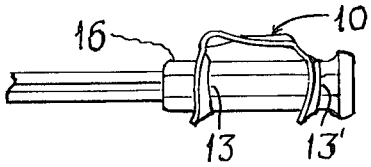
Fig. 2.
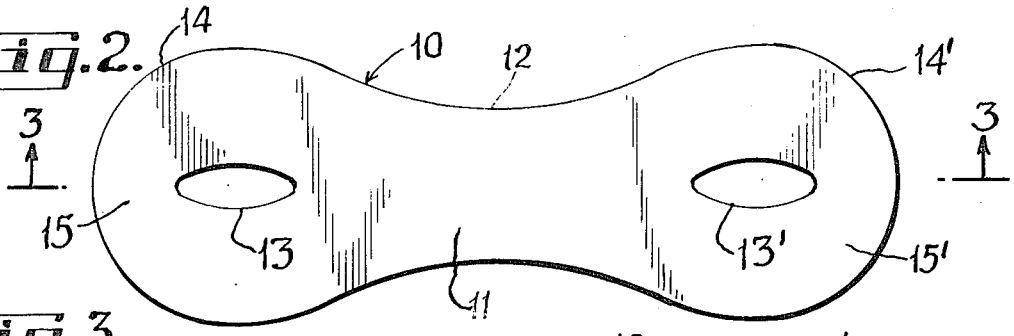
Fig. 3.
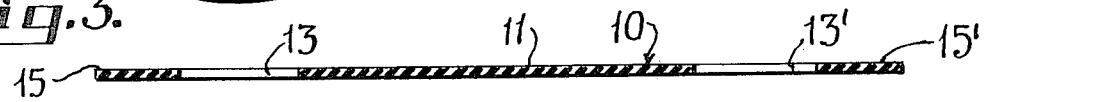
Fig. 4.
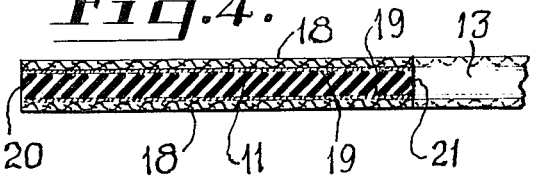
Fig. 5.
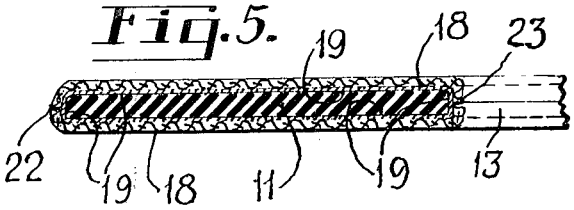
Fig. 6.
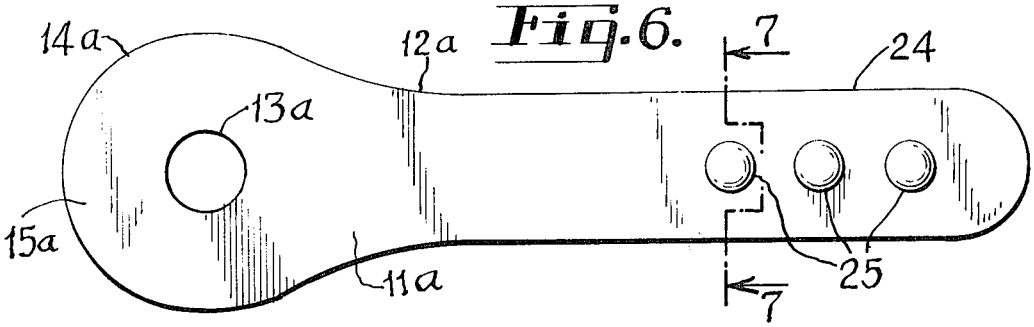
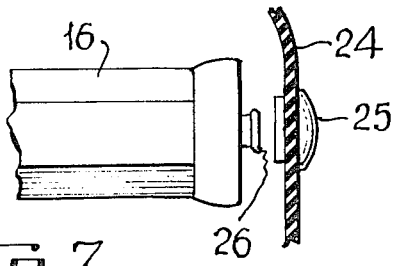
Fig. 7.
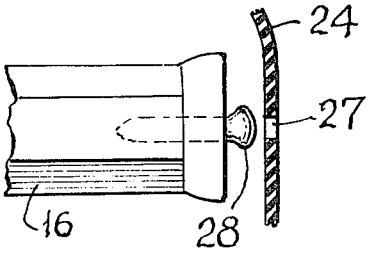
Fig. 8.

Fig. 9
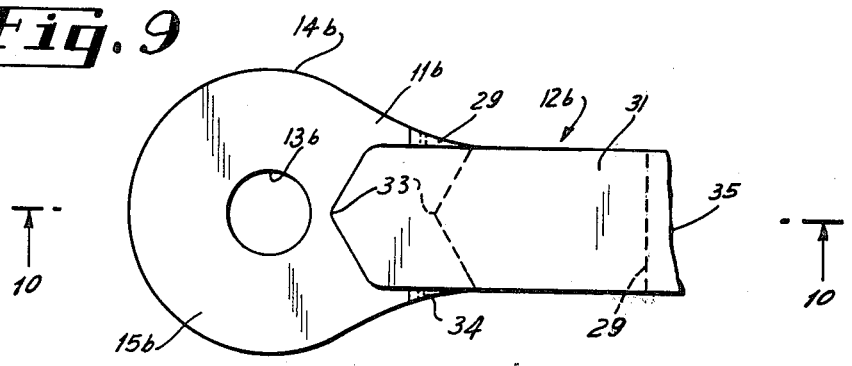
Fig. 10.
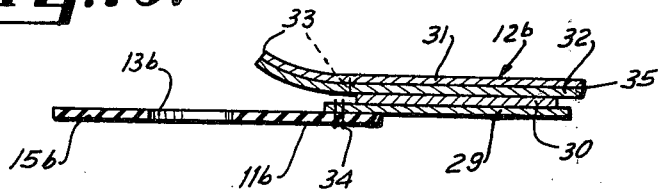
Fig. 11.
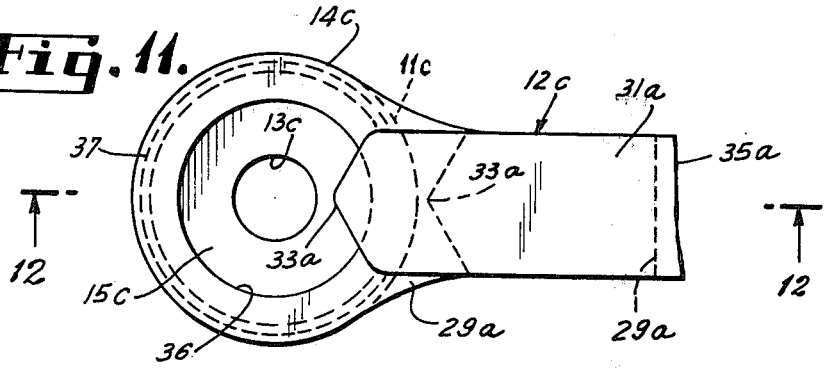
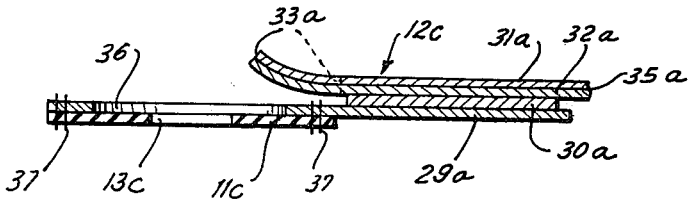
Fig. 12.

SUPPORT DEVICE FOR STRENGTHENING THE HAND GRIPPING OF RACQUET HANDLES AND OTHER SHAFT MEMBERS

This invention relates to a support device for strengthening the hand gripping of racquet handles and other shaft members in the form of an elongated sheet member formed at least in part of resiliently expansible material having means at one end for adjustably securing the member to a shaft to be gripped, and an aperture at the other end of the member of a size to closely and expansibly engage the shaft closely adjacent the gripping hand, with the spacing of said securing means and aperture being such that the device as mounted on a racquet handle or other shaft member forms a loop which receives the hand with sufficient resilient tension to hold the shaft firmly to the palm of the hand even as the gripping action of the fingers may be relaxed. The device can be a unitary member or a two-part member with overlapped portions aligning with the back of the hand and adjustably secured together by quickly engageable and disengageable means.

It is well-known that in sports and other activities involving use of implements in which a shaft member is held in the hand there can be problems in maintaining a firm grip on the shaft member in the intended activity. This is particularly a problem in tennis and other games employing racquet-like implements due to a combination of perspiration moisture causing slippage in the hand and off-center of striking of balls with the playing head tending to cause twisting in the hand.

Others have attempted to provide a solution to this problem as evidenced by a patent to Berzatzy U.S. Pat. No. 3,203,697 relating to a stable gripping tennis racquet handle, and more recent U.S. Pat. No. 3,712,618 to Berzatzy relating to a tennis racquet attachment. Both of these patents, however, relate to structures which add significant hardware and weight which is inherently objectionable, and U.S. Pat. No. 3,203,697 further involves modification of the racquet handle to a flattened or generally elliptical contour which is inherently objectionable as it restricts the player in his freedom of orientating the racquet with the hand.

U.S. Pat. No. 3,712,618 discloses several rigid and deformable but not expansible structures which are heavy and/or cumbersome to use and which leave much to be desired from the stand point of comfort and flexibility in use, particularly in permitting adjustment and readjustment of the racquet in the hand.

Because the device of the present invention can also aid in gripping other shaft handled implements such as ski poles and golf clubs, a preliminary patent search conducted by applicant was extended to these areas. The most pertinent prior patents found in these areas, namely Tobin U.S. Pat. No. 3,880,443 relating to a strapless ski pole grip, and Haws U.S. Pat. No. 3,520,539 relating to a golf glove to aid gripping the club handle approach the problem of shaft support in the hand in manners quite different from that of the present invention.

Considered in certain of its broader aspects, the improved support device for strengthening the hand gripping of racquet handles and other shaft members in accordance with the present invention comprises an elongated sheet member formed at least in part of resiliently expansible material, means at one end of said member for adjustably securing the member to a shaft to be gripped, an aperture at the other end of said member of a size to closely and expansibly engage said shaft, the spacing of said aperture and first named means being such that said device as mounted on said shaft forms a hand receiving loop which is smaller than the circumference of the hand at the base of the fingers but expansible to closely but comfortably engage the back of the hand when inserted to grasp the shaft, whereby the shaft becomes firmly positioned with respect to the palm of the hand even when the finger gripping of the shaft is released. The device can be a unitary member or a two-part member with overlapped portions aligning with the back of the hand and adjustably secured together by quickly engageable and disengageable means.

The sheet member can be die cut or molded from rubber or other elastomeric material and should initially be about 1¼ to 1½ inches wide at the portion which will align with the center of the back of the hand, with the side edges diverging to form an enlarged portion surrounding the shaft engaging aperture. This divergance of the side edges provides for comfortable seating of the device on the back of the hand, with the mounted device extending substantially from the base of the thumb to the base of the index finger, thereby enhancing the support provided by the device.

The device as fashioned from rubber or other elastomeric material can be used as such, or it can provide the core of a composite structure in which expansible fabric is bonded to the opposed surfaces. Various expansible fabrics are commercially available but expansible terry cloth is particularly desirable because of its excellent moisture absorbing properties and soft feel.

The fabric layers can be bonded to the elastomeric core with any compatible adhesive, conventional rubber cement being appropriate when using a rubber core. A preferred method of producing fabric-coated devices is to prebond sheets of fabric to opposed surfaces of a sheet of core material and then die cut the devices from the laminated assemblage. This, of course, leaves the edges of the core exposed, but this in no way interferes with the usefulness of the device.

If it is desired to completely envelope the core with fabric, this is best accomplished by pre-cutting or premolding the core blanks, positioning them between sheets of fabric having appropriate adhesive coatings and then, with cutting and pressing dies, having cutting contours outwardly spaced from edges of the core, effecting in a single operation cutting of the fabric sheets, compressing them against opposed surfaces of the core and pressing together and bonding of the overhanging edges of the fabric.

The means for adjustably securing the device to the shaft or hand grip can vary depending on the type of adjustment primarily desired. If ability to position the hand longitudinally of the shaft or hand grip is desired, such securing means can be a second aperture in the device adapted to closely and expansibly engage the shaft.

If, on the other hand, it is desired to accommodate hands of different sizes or gloved hands in cold weather, the securing means will preferably comprise a plurality of fastener means spaced longitudinally of the device and co-acting with interengaging means on the end of said shaft or hand grip. Such fastening means can suitably be small apertures in the device adapted to closely and expansibly engage lug means at the end of the shaft or hand grip. Alternatively, spaced female snap fasteners on said device can selectively engage a male snap fastener at the end of said shaft or hand grip. The latter type of adjustment can be particularly desirable when the shaft or hand grip is to be grasped by a glove hand, as in the case of ski poles, and racquet games played in cold weather.

Another approach to adjustability in the device is to employ a two-part structure with the parts overlapping in alignment with the back of the hand and secured together in appropriately overlapped relation by quickly engageable and disengageable means. The securing means should provide firm support against tension longitudinally of the device but limited resistance to forces applied perpendicularly of the device. Suitable securing means would be a lattice of studs on one part variably engaging a lattice of sockets on the other part, or a looped texture on one part and a flexible hooked texture on the other part. The latter type, commercially available under the trademark "Velcro" is particularly desirable as permitting wide variation in the orientation of the parts, thereby enabling the user of the device to attain an optimum adjustment for comfort and desired support in his gripping of a racquet hand grip or other shaft member.

In use of the two-part device the tennis player or other user has the option of disengaging the securing means to separate the part ends after a period of use, and rejoining them in preparation for another period of use; or merely slipping out his hand and reinserting it in the loop between periods of use. It is considered that the latter procedure is more likely to be followed after the user has adjusted the device to what he considers an optimum fit.

The support device was developed particularly to help the players in tennis and other racquet games. In such uses it provides a number of distinct benefits including minimizing slippage of the racquet handle due to perspiration, countering at least in part the twisting action due to off-center striking of balls, maintaining a desired orientation of the racquet in the hand, and relieving tension by permitting a relaxing of the grip between periods of action without loss of the prearranged racquet orientation in the hand.

The device, however, lends itself to many other uses as, for example, on ski poles as above-mentioned, as an aid to gripping golf clubs, and as an aid in maintaining alignment of oars. In fact, the device is potentially useful in any instance where an implement having a shaft or hand grip of generally cylindrical contour has a "working portion" for which proper angular orientation with respect to the hand is important.

The improved support device in accordance with the present invention will be more fully understood from a consideration of the following description, having reference to the accompanying drawing in which preferred adaptations of the invention have been illustrated with the parts and details thereof identified by suitable reference characters in each of the views, and in which:

FIG. 1 is a view of a hand holding a racquet with the support device in operative engagement therewith.

FIG. 1*a* is a view similar to FIG. 1 with the racquet rotated 90° and the hand removed.

FIG. 2 is a plan view of a preferred form of support device.

FIG. 3 is a sectional view substantially on the line 3—3 of FIG. 2.

FIG. 4 is an enlarged view of the left end portion of the device shown in FIG. 3 with expansible fabric bonded to opposed surfaces.

FIG. 5 is a view similar to FIG. 4 showing a modified construction in which the fabric layers are slightly larger and are bonded to each other along edge contours of the device.

FIG. 6 is a plan view similar to FIG. 2 but showing a modified structure with a plurality of securing means at one end of the device.

FIG. 7 is a fragmentary view of the device shown in FIG. 6 taken on the line 6—6 and aligned with the co-acting end of a hand grip member.

FIG. 8 is a view similar to FIG. 7 showing a modified type of securing means.

FIG. 9 is a partial view similar to FIGS. 2 and 6 showing a two-part construction.

FIG. 10 is a sectional view substantially on the line 10—10 of FIG. 9.

FIG. 11 is a view similar to FIG. 9 showing a modified form of two-part construction, and FIG. 12 is a sectional view substantially on the line 12—12 of FIG. 11.

As shown in FIGS. 1 to 3 of the drawing, the support device 10 comprises an elongated and relatively thin sheet of elastomeric material 11 having a relatively narrow mid-section 12 longitudinally spaced apertures 13, 13' and enlarged end portions 14, 14' which provide relatively broad bands of material 15, 15' around said apertures.

As shown in FIGS. 1 and 1*a*, apertures 13, 13' expansively engage spaced portions of the hand grip member such as the racquet handle 16 to form a loop of the device 10 through which a hand 17 is passed when gripping the member 16. The spacing of the apertures 13 and the elastomeric properties of the device 10 are such that the loop formed by the device 10 as shown in FIG. 1 will comfortably but firmly support the palm of the hand in engagement with the member 16.

The thickness of the sheet 11 of elastomeric material should be such as to permit about 50% to 100% elongation of the device when tensioning force is applied to the ends thereof; and when the elastomeric material is rubber, and the mid-section 12 of the device is about 1¼ to 1½ inches wide, an appropriate thickness of the device will be about 0.05" to 0.06".

It will be noted that the narrow mid-section 12 aligns substantially with the center of the back of the hand 17 as shown in FIG. 1 and the curvature of the side edges of the device in moving from the mid-section 12 to the enlargements 14, 14' provide that the device will engage the back of the hand, at the thumb side thereof, from a point in substantial alignment with the base of the thumb to a point in substantial alignment with the base of the index finger. This broad engagement with the back of the hand, coupled with the tensioning in the band portion 15 as the aperture 13 is engaged with the hand grip member 16, provides a unique support of the hand grip member 16 against twisting in the hand. It will be noted in this connection that with proper setting of the device the racquet handle or hand grip member 16 is held firmly to the palm of the hand and supported against rotation even if the gripping action of the fingers and thumb are relaxed, as by freely extending the fingers and thumb. At the same time the orientation of the racquet handle or other hand grip member 16 can easily be changed by forcibly rotating the member 16 within the apertures 13, 13'. The ability to thus adjust, and maintain adjustment of, the rotary orientation of hand grip member 16 with respect to the hand is particularly advantageous to the players of tennis and other racquet games where proper orientation of the racquet is of prime significance. It can be equally advantageous, however, to the golfer in being able to preset the alignment of the club face for a particular stroke, and being sure that the preset alignment will be maintained throughout the swing. In fact, the support provided against rotation of the hand grip member 16 by reason of the broad, base of the thumb to base of the index finger, engagement with the hand provides special advantage in any instance where the hand grip member 16 is on an implement for which the active or working portion requires control of rotational alignment.

The support device as shown in FIGS. 1 to 3 can be formed in various ways as by molding, or by die-cutting from sheet elastomeric material. The apertures 13, 13', which are shown of generally elliptical contour in FIG. 2, can be of any desired contour, including round or circular as shown in FIG. 6. It is preferable, however, that the apertures area 13 or 13' be smaller than the cross sectional area of the hand grip member 16 on which it is to be used, so that engagement with the hand grip member involves a resiliently expansible enlargement of the aperture. It is this expansible engagement, throughout at least a major portion of the encircled periphery of the hand grip 16 that supports the hand grip against rotational movement in the support.

For many purposes the simple molded or die-cut support device as shown in FIGS. 1 to 3 is all that is needed. There are times, as in the warm weather playing of tennis and other racquet games, when perspiration moisture in the hands, a condition known to vary greatly from one individual to another, can cause a problem. This problem can, however, be offset as shown in FIG. 4 by bonding layers of expansible fabric 18 to opposed surfaces of the sheet 11 of elastomeric material by layers of compatible adhesive 19. When the sheet material or core 11 of this assemblage is fashioned of rubber, a conventional rubber cement is appropriate for bonding the layers of fabric 18.

It is to be understood that the showing of fabric 18 in FIG. 4 is purely diagrammatic. Various types of expansible fabric can be used, with expansible terry cloth being particularly desirable because of its softness and absorbent properties.

The fabric-coated device as shown in FIG. 4 is most readily produced by first bonding large sheets of fabric to a sheet of elastomeric material and die-cutting the complete composite devices from such assemblage. The fact that outer edges 20 or inner edges 21 of the elastomeric material 11 remain exposed in no way interferes with the effectiveness of the composite device.

An alternative procedure is to pre-form the basic device 10 by die-cutting or molding and then, with suitable adhesive, bond coextensive or slightly larger members of fabric 18 to the elastomeric member or core 11. If an assemblage of adhesive coated fabrics with the pre-formed core 11 therebetween is placed in a cutting and pressing die, with cutting elements slightly spaced from outer edges 20 and inner edges 21 of the core 11, the outer edges 22 and the inner edges 23 of the layers of fabric 18 will be bonded together by adhesive 19 as diagrammatically shown in FIG. 5.

The support device containing two apertures 13, 13' as shown in FIGS. 1 to 3 is particularly desirable when the user wishes to be able to adjust the position of his hand longitudinally of racquet handle or other hand grip 16. In some instances, however, it may be more important to permit the device to be adaptable to different size hands, or to differently gloved hands, as in the grasping of ski poles. In such instances a support device of somewhat modified structure as shown in FIGS. 6 to 8 may be employed.

As shown in FIG. 6 the left hand side of the device will be essentially the same as in FIGS. 1 to 3 comprising a sheet **11*a* of elastomeric material having at 12*a* a portion about $1\frac{1}{4}$ to $1\frac{1}{2}$ inches wide adapted to align with the center of the back of a hand 17, and curving to an enlarged portion 14*a* forming a broad band 15*a* around an aperture 13*a*, here shown as having a round contour. The right hand end as shown in FIG. 6 comprises a strap portion 24 of generally the same width as the portion 12*a* and of a length to receive a plurality of longitudinally spaced securing means, shown in FIGS. 6 and 7 as female snap fastener elements 25 which can selectively engage a male snap fastener element 26 on the end of a racquet handle or other hand grip 16. Other types of securing means can be employed, however, and the simplest is to provide longitudinally spaced apertures 27 in the strap portion 24 which are small enough to closely and expansibly engage a lug 28 on the end of the hand grip member 16 as shown in FIG. 8**.

It is preferable that there be at least three longitudinally spaced securing means 25 or 27 in the strap portion 24 to provide versatile variation in the size of the hand engaging loop formed by the device on a hand grip member 16. In fact, with the form of construction shown in FIGS. 1 to 3 it is contemplated that there be three stock sizes to accommodate size variation in adult hands, and additional stock sizes if the device were intended to be used by children.

The composite, expansible fabric-coated construction shown in FIGS. 4 and 5 can also be employed in the modifications shown in FIGS. 6 to 8. In the event that the securing means on the strap 24 are to be snap fastener elements 25, these will, of course, be applied as a final step in fabrication of the otherwise completed device.

In the modified form of construction shown in FIGS. 9 to 12, the device is fashioned in two parts overlapping and adjustably secured together at the portion thereof which aligns with the back of the hand as the device is used in supporting the grip on a racquet handle or the like. This modification does not alter the basic functioning or manner of using the device as previously described but adds the advantage of providing greater variation in size of the hand enveloping loop, and more precise "vernier" adjustment of the fit which may be most comfortable for the individual user.

As shown in FIGS. 9 and 10, the overlapped midsection **12*b* comprises a relatively short, flexible but non-extensible sheet member 29 having adhesively bonded or otherwise secured thereto the male component 30 of a pressure fastening means, and an overlapping longer, flexible but non-extensible sheet member 31 having bonded or otherwise secured thereto the female component 32 of a pressure fastening means. Any conventional, longitudinally adjustable pressure fastening means can be employed, such, for example, as a grid of studs as the component 30 and a mating grid of apertures as the component 32, which will permit engagement in different positions of orientation and easy separation by a lifting or peeling of the end 33 of the member 31. A particularly effective pressure fastener is the commercially available "Velcro" fastener, with component 30 being the hooked member and component 32** being the looped member of a conventional "Velcro" fastener.

Secured to one end of the flexible but non-extensible sheet member 29, as by lines of stitching 34 is a sheet of elastomeric material 11*b*, fashioned to provide an enlarged curved portion 14*b* forming a broad band 15*b* around an aperture 13*b* corresponding in every respect to the similarly numbered parts shown, and described in connection with FIGS. 1 to 6.

It will be understood that the two part construction shown in FIGS. 9 and 10 can be adapted to any of the modifications shown in FIGS. 1 to 8. For this reason, and to avoid an undue multiplicity of views, the member 31 in FIGS. 9 and 10 has been shown broken at 35. Beyond this point one can visualize a second assemblage similar to that above described joining elastomeric member 11*b* to the member 29, as providing a two-piece variation of the device as shown in FIG. 1. Similarly, one can readily visualize the member 31 as longitudinally extended and carrying longitudinally spaced securing means to provide a two-piece variation of the device shown in FIG. 6.

The size adjustment of the support device provided by the two-piece construction is readily visualized by realizing that the parts can be oriented to have the end 33 of member 31 terminate anywhere between the full and dotted line showings in FIG. 9. Thus a single stock size of the two-piece form of the device can comfortably be fitted to a range of hand sizes. An individual user can, if desired, after determining the proper adjustment for his hand, remove any excess length of the member 31 by cutting it off at approximately the position of dotted line 33.

In the modification shown in FIGS. 11 and 12 the central portion of the device 12*c*, the overlapped members 29*a* and 31*a*, the pressure fastening means 30*a* and 32*a*, and the significance of details 33*a* and 35*a* are identical with the similarly numbered components and details of FIGS. 9 and 10 except that the flexible but non-extensible sheet member 29*a* is extended to include the enlarged curved portion 14*c* having an enlarged aperture 36 therein and the elastomeric member 11*c* is in the form of a ring having a reduced central aperture 13*c* and providing a broad elastomeric band 15*c* which is peripherally secured to the member 29*a* as by the lines of stitching 37.

The structure as shown in FIGS. 9 to 12 provide the important resiliently expansible engagement with a racquet handle or other shaft member being gripped, as earlier described. These structures obviously do not have the resilient expansibility in the central portions 12*b* or 12*c* which characterizes the FIGS. 1 to 8 adaptations of the device, but this is offset by the "vernier" type adjustment in fitting the device to the hand of a particular individual, provided by the pressure fastening means 29, 31 or 29*a*, 31*a*. In fact, there is special advantage in the use of the pressure fastener because it permits slight size adjustments to be made to provide the most comfortable fit as the hand may swell due to the heat or the stress of the user.

Various changes and modifications in the support device as herein disclosed will occur to those skilled in the art, and to the extent that such changes and modifications are embraced by the appended claims, it is to be understood that they constitute part of the present invention.

I claim:

1. A support device for strengthening the hand gripping of a racquet handle or other hand grip shaft when held in the palm and encircled by the fingers of the hand, said device being substantially planar and formed of flat sheet material which has planar flexibility and at least in part is resiliently expansible, the central portion of said device being adapted to overlie the back of the hand, one end of the device adapted to extend beyond the thumb side of the hand and having an enlarged enclosed planar rounded contour portion which is substantially wider than said central portion said rounded contour portion being resiliently expansible and having a central aperture spaced from the outer periphery thereof with said aperture being within the plane of said sheet material, said central aperture being of a size to closely and expansibly engage said hand grip shaft while establishing essentially linear circumferential contact therewith, said enlarged rounded contour extending into said central portion to engage the back of the hand from the base of the thumb to the base of the index finger, the other end of said device adapted to extend beyond the other side of the hand and having means adjustably engaging and securing said other end to said hand grip shaft, said device as mounted on a hand grip shaft providing a hand receiving loop which resiliently supports the palm of the hand in firm, comfortable engagement with the hand grip shaft even when finger gripping of the shaft is released, and the essentially linear circumferential and expansible contact of said central aperture with a hand grip shaft in conjunction with said securing said other end to said base-of-thumb to base-of-index-finger engagement with the back of the hand maintaining rotary orientation of the hand grip shaft with respect to the relaxed hand, while permitting easy forceful rotary adjustment of the hand grip shaft.

2. A support device as defined in claim 1, wherein the entire length of said device comprises a unitary sheet of resiliently expansible material.

3. A support device as defined in claim 2, wherein the resiliently expansible nature of said sheet material is such as to permit a 50% to 100% elongation when longitudinal tensioning force is applied to the device.

4. A support device as defined in claim 2, wherein said sheet is rubber.

5. A support device as defined in claim 2, wherein said sheet material is rubber about 0.05" to 0.06" thick and about 1¼" to 1½" wide in its mid-section and is capable of about 50% to 100% elongation when longitudinal tension is applied to the device.

6. A support device as defined in claim 2, wherein said device is a composite body comprising a core of elastomeric material having bonded to opposed surfaces thereof sheets of a stretchable fabric material.

7. A support device as defined in claim 6, wherein the sheets of fabric have dimensions co-extensive with those of the core.

8. A support device as defined in claim 6, wherein the sheets of fabric overlie slightly the contour edges of the core, and said overlying edges of the sheets of fabric are directly bonded together, whereby all flat and edge surfaces of said core are covered by fabric.

9. A support device as defined in claim 2, wherein said sheet member is a composite body comprising a core of sheet rubber having bonded to opposed surfaces thereof by means of rubber cement sheets of a stretchable terry cloth material.

10. A support device as defined in claim 1, wherein the securing means on said other end is a second aperture closely and expansibly engaging the hand grip shaft, thereby adapting the device for longitudinal adjustment along the hand grip shaft.

11. A support device as defined in claim 1, wherein the securing means on said other end comprises a plurality of fastener means spaced longitudinally of the device adapted to selectively engage cooperating fastener means on the end of the engaged hand grip shaft, thereby permitting proper accommodation of different sized hands.

12. A support device as defined in claim 11, wherein said fastener means comprise small apertures in said device adapted to closely and expansibly engage lug means at the end of said hand grip shaft.

13. A support device as defined in claim 11, wherein said fastener means comprise female snap fastener elements secured to said device and adapted to selectively engage a male snap fastener at the end of said hand grip shaft.

14. A support device as defined in claim 11, wherein at least three fastener means are spaced longitudinally of the device so that the loop formed by the device can be adjusted to comfortably engage hands of widely differing size.

15. A support device as defined in claim 1, wherein said device is of two part construction with said two parts providing overlapping layers at said central portion of the device, said overlapping layers carrying coacting components of longitudinally variable pressure fastener means, and the fastener means on the outer of said overlapping layers being substantially longer than the fastener means on the inner layer, thereby permitting said device to snugly engage hands of varying size.

16. A support device as defined in claim 15, wherein the inner of said overlapping layers carries male fastener means, the outer of said layers carries female fastener means, and engagement of said fastener means in a desired position of adjustment is achieved by application of pressure, while disengagement is effected by longitudinal peeling of said outer layer.

17. A support device as defined in claim 15, wherein resiliently expansible material is employed in only those portions of the device which carry an aperture expansibly engaging said hand grip shaft.

18. A support device as defined in claim 17, wherein both ends of the device have apertures expansibly engaging said hand grip shaft.

19. A support device as defined in claim 17, wherein one end of the device has an aperture expansibly engaging said hand grip shaft, and the other end of said device has a plurality of longitudinally spaced fastener means adapted to selectively engage cooperating fastener means on the end of said hand grip shaft.

* * * * *